United States Patent [19]

Reichle

[11] Patent Number: 4,910,381

[45] Date of Patent: Mar. 20, 1990

[54] HAIR DRYING DEVICE

[75] Inventor: Heinz Reichle, Lenningen, Fed. Rep. of Germany

[73] Assignee: ABC-Elektrogeräte Volz, GmbH & Co., Kirchheim/Teck, Fed. Rep. of Germany

[21] Appl. No.: 260,826

[22] Filed: Oct. 21, 1988

[30] Foreign Application Priority Data

Oct. 24, 1987 [DE] Fed. Rep. of Germany ..... 3736100

[51] Int. Cl.[4] ..... A45D 24/00

[52] U.S. Cl. ..... 219/222; 132/238

[58] Field of Search ..... 219/222, 225, 370, 373; 34/96, 101; 132/226, 227, 237, 238, 239, 269; 318/284, 285, 280, 293

[56] References Cited

U.S. PATENT DOCUMENTS

| | | | |
|---|---|---|---|
| 3,549,971 | 12/1970 | Van Patten | 318/293 |
| 3,581,174 | 5/1971 | Hammer | 318/285 |
| 3,584,281 | 6/1971 | Reeves | 318/284 |
| 3,890,984 | 6/1975 | Lesetar | 132/238 |
| 4,166,472 | 9/1979 | Battaglia | 219/222 |
| 4,234,834 | 11/1980 | Jennings | 318/285 |
| 4,409,998 | 10/1983 | Bauer | 132/227 |
| 4,438,378 | 3/1984 | Tanaka | 318/280 |

FOREIGN PATENT DOCUMENTS

| | | | |
|---|---|---|---|
| 2106384 | 4/1983 | United Kingdom | 219/225 |

*Primary Examiner*—M. H. Paschall
*Assistant Examiner*—Geoffrey S. Evans
*Attorney, Agent, or Firm*—Marmorek, Guttman & Rubenstein

[57] ABSTRACT

A hair drying device comprises a rotatable curling iron, a reversible motor for driving the curling iron, a reversing switch connected to the reversible motor for causing the motor to reverse its direction of rotation, and a hair dryer including an outflow nozzle for directing hot air produced by the hair dryer tangentially at hair wound upon the curling iron. The outflow nozzle is movable between first and second positions. The outflow nozzle and the reversing switch are coupled together so that the curling iron is caused to rotate in one direction when the outflow nozzle is in its first position, and in an opposite direction when the outward nozzle is in its second position. An electric circuit includes a first switch which is actuated directly by the reversing switch and a second switch which is actuated by the reversing switch after a predetermined time delay, preferably by an RC circuit. As a result, when the reversing switch is actuated by movement of the outflow nozzle, the motor is first caused to stop rotating in one direction, and after a predetermined time delay it is caused to rotate in an opposite direction.

11 Claims, 5 Drawing Sheets

HAIR DRYING DEVICE

BACKGROUND OF THE INVENTION

The instant invention relates to a hair drying device having a rotatable curling iron and a hair dryer. More particularly, the present invention relates to a hair drying device which includes a curling iron which is rotatable in opposite directions and a movable outflow nozzle for directing hot air tangentially at hair wound on the rotating curling iron, the direction of rotation of the curling iron being coupled to the movement of the outflow nozzle. A hair treatment having a rotatable curling iron and a hair dryer is known from EP patent 0 052 325, which is incorporated herein by reference.

It is the object of the instant invention to create an especially simple design for synchronizing the movement of the outflow nozzle with reversal of the direction of rotation of the drive motor of the curling iron in a drying device of this kind. At the same time great durability is to be ensured for all of the mechanical parts. In the sense o a secondary object, this means that the forces developed when braking and resuming rotation of the curling iron in the opposite direction should be kept as low as possible. Furthermore the mechanical switching means for the activation of the reversing switch should be of the simplest possible design.

SUMMARY OF THE INVENTION

These and other objects have been attained by means of the hair drying device of th present invention which comprises a rotatable curling iron, a reversible motor for driving the curling iron, a reversing switch connected to the reversible motor for causing the motor to reverse its direction of rotation, and a hair dryer including an outflow nozzle for directing hot air produced by the hair dryer tangentially at hair wound upon the curling iron. The outflow nozzle is movable between first and second positions. The outflow nozzle and the reversing switch are coupled together so that the curling iron is caused to rotate in one direction when the outflow nozzle is in its first position, and the curling iron is caused to rotate in an opposite direction when the outflow nozzle is in its second position. An electric circuit is disposed between a source of electricity and the reversible motor. The electric circuit includes a first switch which is actuated directly by the reversing switch and a second switch which is actuated by the reversing switch after a predetermined time delay.

In a preferred embodiment, the electric circuit further includes first and second lines leading to the drive motor, the first switch being disposed in the first line, the second switch being disposed in the second line, and first and second relays associated with the first and second switches. The first switch is caused to change position directly by the reversing switch, and an RC circuit associate with the second switch causes the second switch to change position after a predetermined time delay. As a result, when the reversing switch is actuated by movement of the outflow nozzle, the motor is first caused to stop rotating in one direction, and after a predetermined time delay it is caused to rotate in an opposite direction.

BRIEF DESCRIPTION OF THE DRAWINGS

Preferred embodiments of the invention are described in greater detail through the drawings in which.

DETAILED DESCRIPTION OF PREFERRED EMBODIMENT

Figure 1:
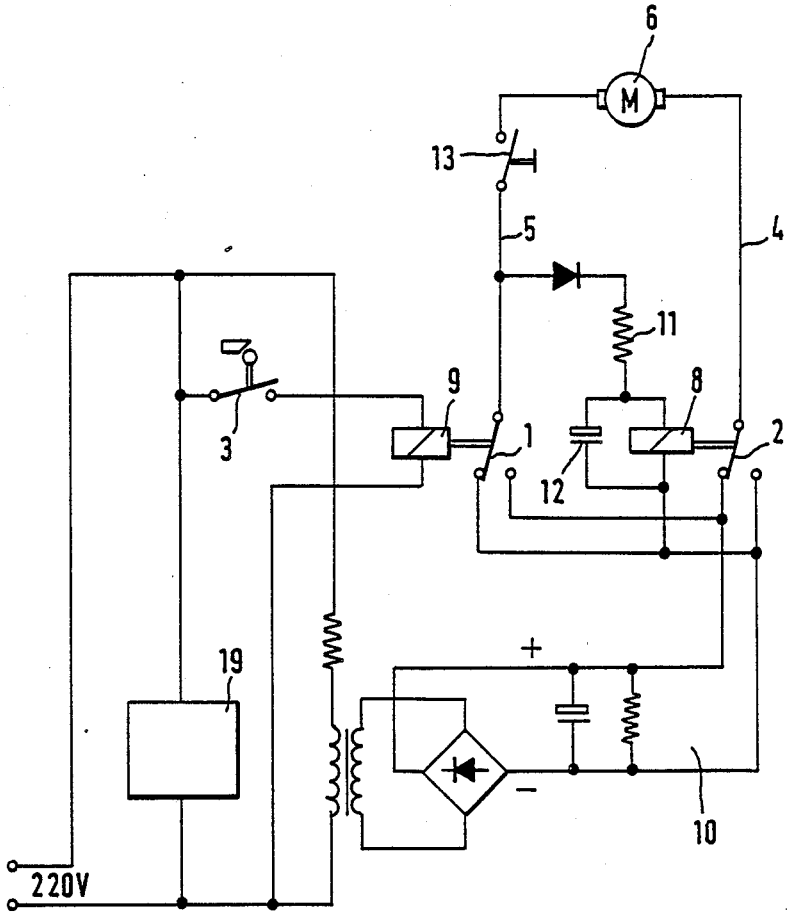
FIG. 1 shows a circuit diagram for reversing the direction of rotation of the drive motor of a curling iron in a hair drying device of the present invention.

Referring to FIG. 1, a hair dryer 19 is connected to the connecting terminals of a 220 V supply and to a relay 9 via a reversing switch 3. The reversing switch 3 is a simple key switchable between the two positions "contact" and "no contact". Also connected to the supply current of 220 V is a conventional supply element 10 constituted by a transformer and a four-way rectifier. The supply element 10 supplies a DC voltage of 24 volts to the drive motor 6 of the curling iron 7.

In the voltage supply circuit 5 to the drive motor 6 is a starting switch 13. If the starting switch 13 is closed, the drive motor 6 rotates in a given direction predetermined by the polarity of the output voltage at the output of the supply element 10. If the reversing switch 3 is then activated, the relay 9 causes switch 1 to change over. This causes both voltage supply circuits 4 and 5 of the drive motor 6 to be connected to the same voltage and the two voltage supply circuits are short-circuited. This results in braking until stoppage of drive motor 6 occurs. At first no resumption of rotation in the opposite direction occurs. This only occurs after passage of a predetermined time constant which is derived from the resistance 11 and the capacitor 12. The reason for this is that the reversal of switch 1 by relay 9 coincides with the connection of the voltage supply circuit 5 via resistance 11 and capacitor 12 to the DC voltage at the output of the supply element 10. At the end of the predetermined time constant, the relay 8 enters into play and reverses switch 2. Thereby, the drive motor 6 of the curling iron 7 is now connected to a voltage the polarity of which is opposite to the voltage used originally, and therefore also rotates in the opposite direction. The reversing switch 3 thus first causes braking by means of a short-circuit of the drive motor 6, and only after a given time constant causes resumption of rotation in the opposite direction. This serves to treat all mechanical elements gently and to reduce the forces occurring upon reversal of rotation.

Figure 2:
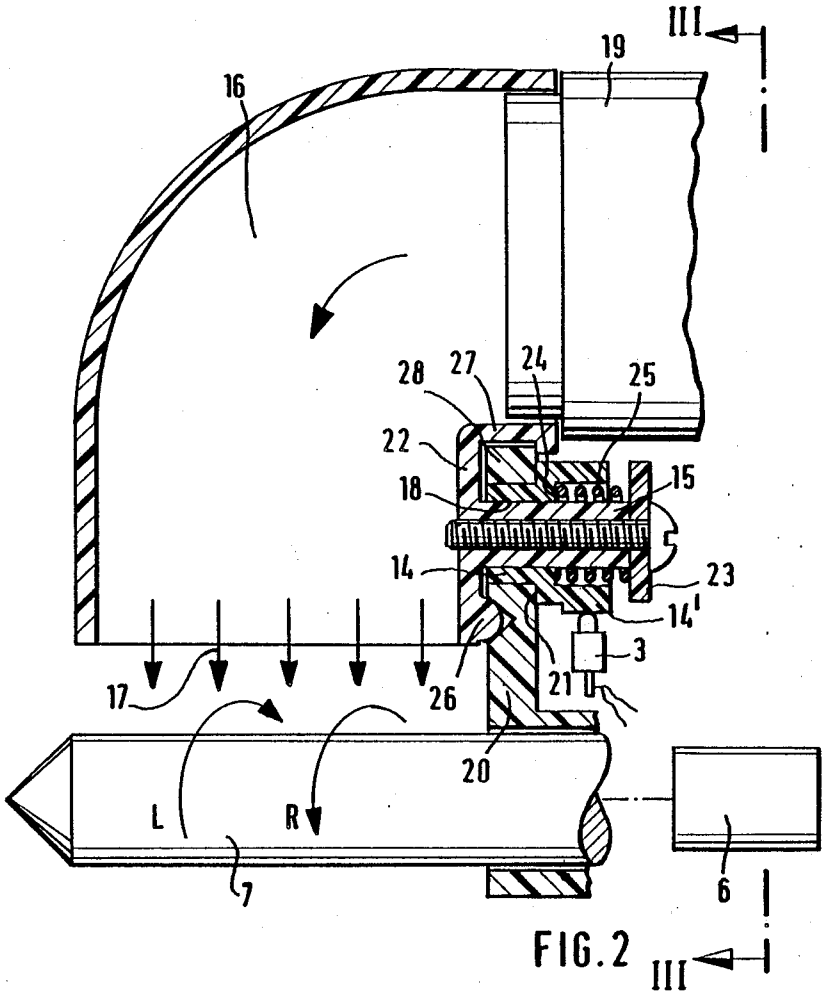
FIG. 2 shows a cross-section through a first embodiment of the reversing means on the outflow nozzle.

FIG. 2 shows a portion of the mechanical structure of a hair drying device of the type mentioned. For a further disclosure of the hair drying device, reference is made to EP patent 0 052 325 mentioned initially. FIG. 2 shows the curling iron 7 with the drive motor 6 indicated only schematically. The curling iron 7 is installed rotatably in a housing of which the housing wall 20 is shown. The hair dryer 19 is fixedly installed on the housing element of which housing wall 20 is a part. This can be achieved in many different ways and is not shown in detail. Furthermore, the outflow nozzle 16 is installed so as to be capable of swivelling in a plane that is perpendicular to the plane of FIG. 2, and this ensures, similarly as in FIGS. 9 and 10 (also see the cited European patent) that the hair wound-up on the curling iron is subjected to a tangential flow in different positions of the outflow nozzle. Furthermore, the outflow nozzle 16 deflects in each of its positions the hot air stream emerging from the hair dryer at a right angle so that the outflow direction 17 results.

The wall 20 is provided with a kidney-shaped slit 18 (see FIG. 3) through which a projection 15 which is an integral part of wall 22 of the outflow nozzle 16 extends. The projection 15 can for example be fashioned with a square cross-section. A sliding block 14 with an index plate 14' is seated on this square projection. The sliding block 14 presses with its heel 21 against the housing wall 20 on its side away from wall 22. The sliding block 14 is furthermore provided with another heel 24. A spring 25 which is a pressure spring presses against the latter and bears with its other end against disk 23 which is rigidly connected to the projection 15. In this manner, the wall 22 of the outflow nozzle 16 and thereby the outflow nozzle 16 as a whole are constantly pulled to the right as shown in FIG. 2. However, it can be moved somewhat to the left, against the force of spring 25 to change its position by being manipulated to this effect. The position is fixedly maintained by means of a catch 26 comprising a knob which catches in the wall 20 by means of an appropriate notch and/or recess. In this way the outflow nozzle 16 is held against the housing wall 20 while remaining adjustable. When the outflow nozzle 16 is adjusted in the plane perpendicular to the plane of FIG. 2, the index plate 14' also moves and activates the reversal switch 3 accordingly.

Figure 3:
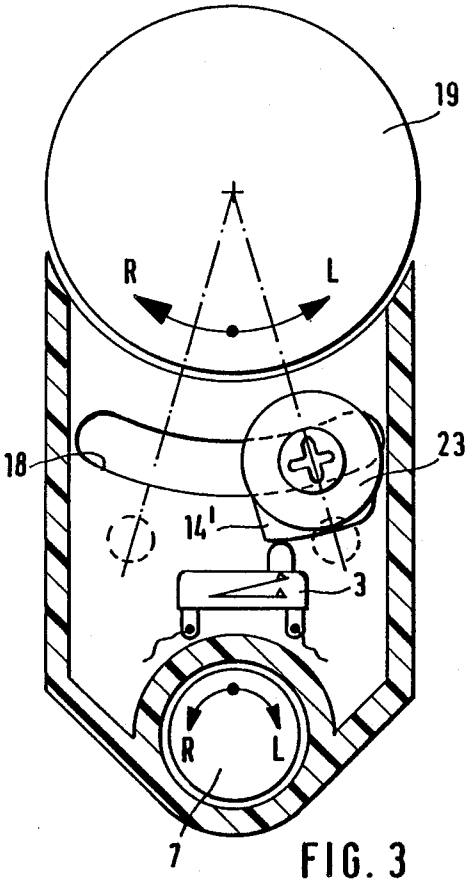
FIG. 3 shows a sectional view taken along the direction of the arrows III—III in FIG. 2.

It is important for the structural design according to FIGS. 2 and 3 for a holding device 27 with a U-shaped cross-section to be provided at the upper end of the wall 22 of the outflow nozzle 16, whereby the U-shape goes around the end zone 28 of the wall 20 in a hook-like manner.

Figure 4:
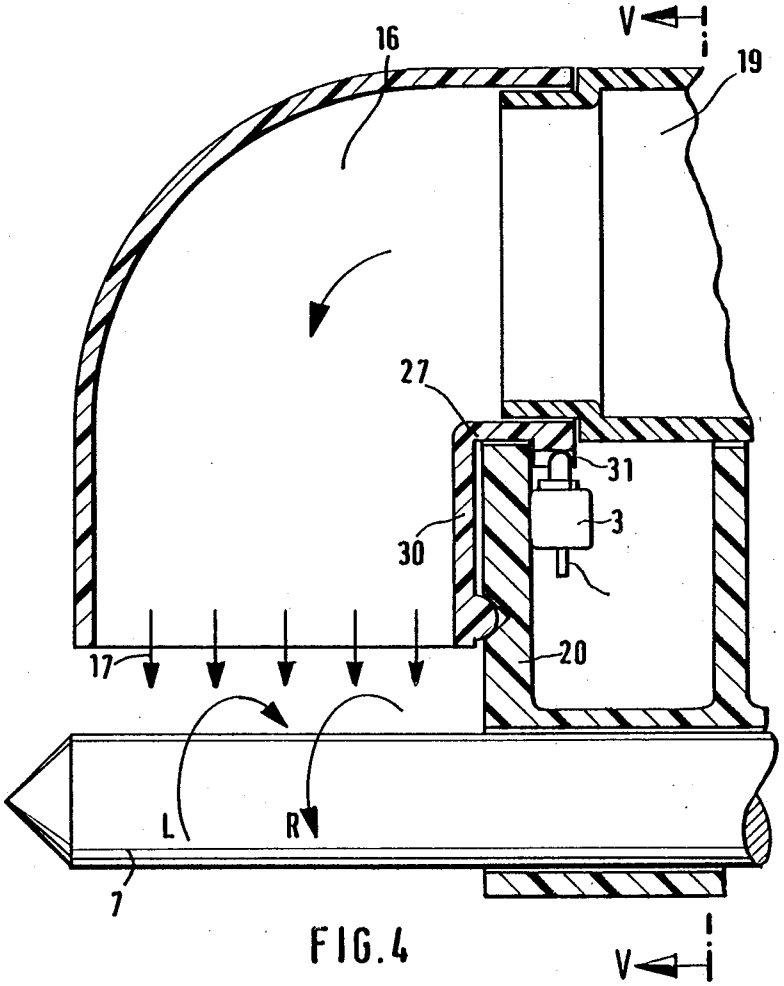
FIG. 4 shows a second embodiment of the reversing means on the outflow nozzle.
Figure 5:
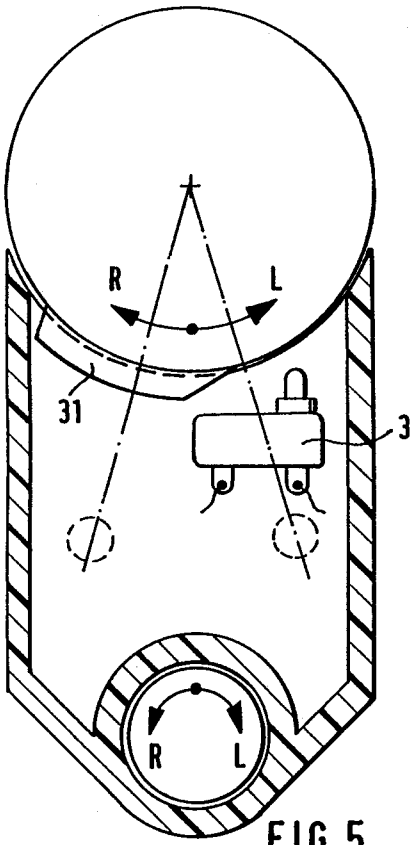
FIG. 5 shows a sectional view taken along the direction of arrows V—V in FIG. 4.

The embodiment according to FIGS. 4 and 5 distinguishes itself from the embodiment according to FIGS. 2 and 3 with respect to the switching means activating the reversal switch 3 in that the index plate 31 is integrally attached to the holding device 27 of the housing wall 30 of the outflow nozzle 16.

Figure 6:
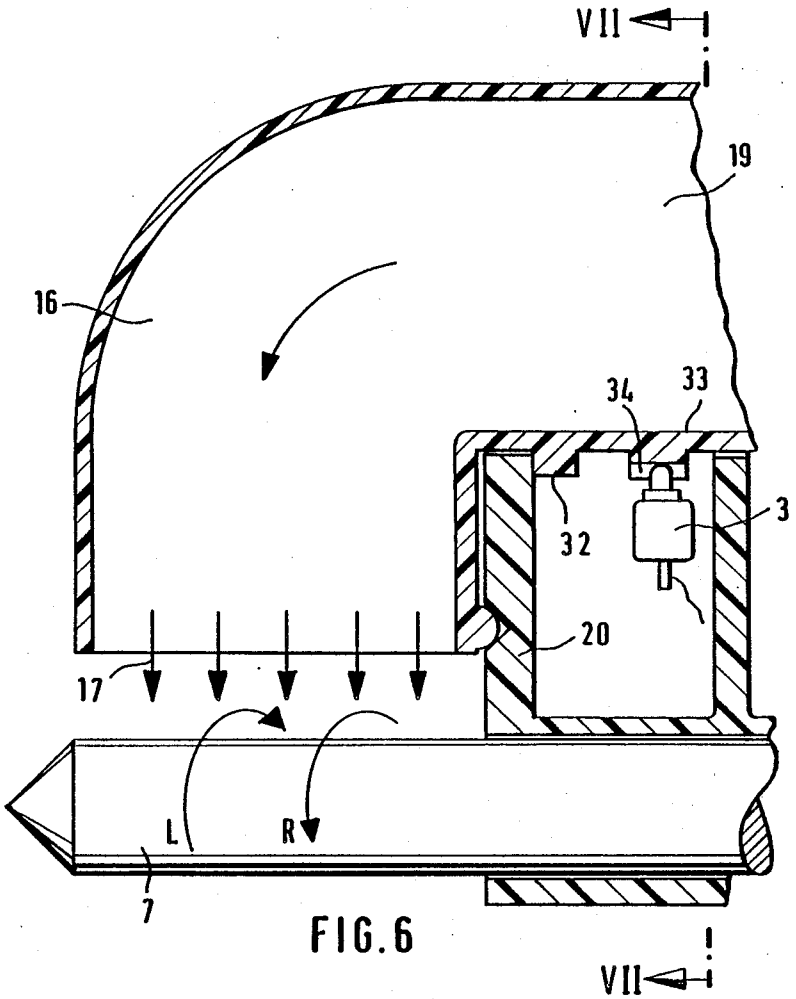
FIG. 6 shows a third embodiment of the reversing means on the outflow nozzle.
Figure 7:
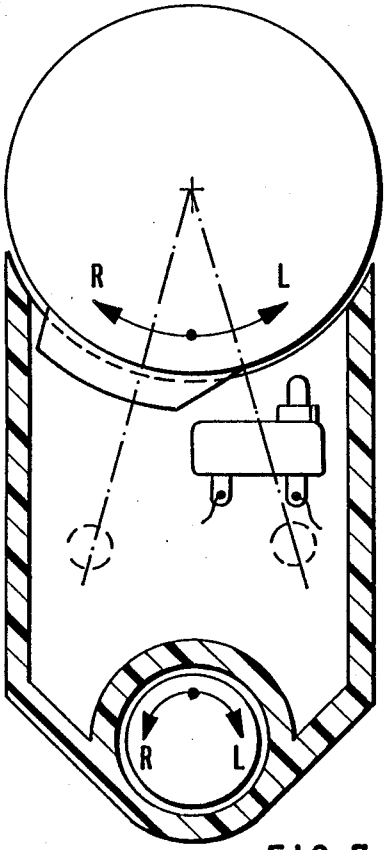
FIG. 7 shows a sectional view taken along the direction of arrows VII—VII in FIG. 6.

The embodiment according to FIGS. 6 and 7 goes one step further in the matter of integration of the individual parts, in that the outer housing of the hair dryer 19 and the outflow nozzle 16 form one single part, whereby a guide collar 32 is provided on the one hand at the housing wall 33 of the hair dryer, surrounding the housing wall 20 in the form of a U and, at a separate location but integrally combined with the housing wall 33 of the hair dryer, the index plate 34 is provided.

Figure 8:
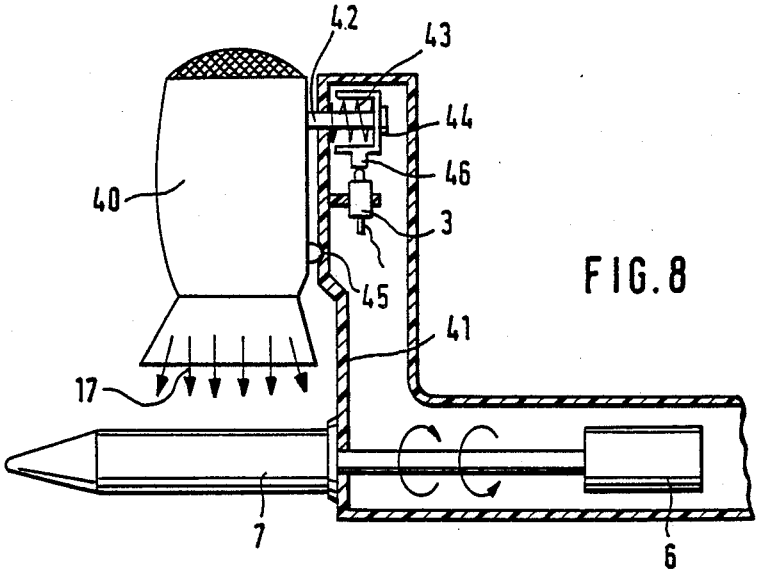
FIG. 8 shows a further embodiment of the hair drying device.
Figure 9:
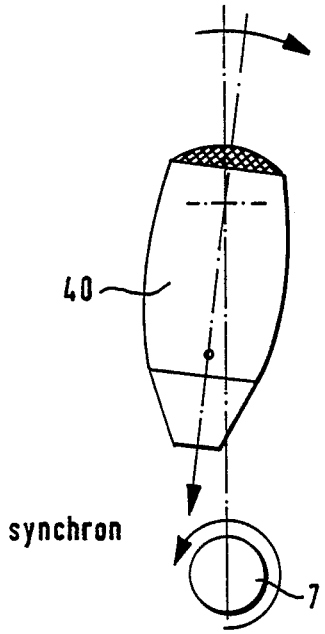
FIGS. 9 and 10 show different positions of the hair drying device illustrated in FIG. 8.
Figure 10:
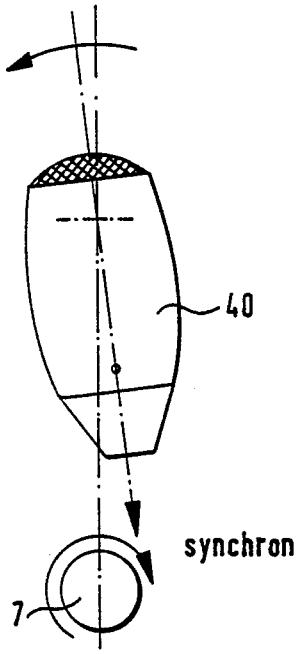

FIGS. 8 to 10 show alternative forms of the arrangement or design of the hair dryer 40. Its axis is now coaxial with the outflow direction 17 which is defined by the function defined initially. In this design a pivot pin 42 is provided at the upper part of the hair dryer 40, said pin traversing the housing wall 41 and bearing a disk 44 at its end. A pressure spring 43 takes effect between the disk 44 and the housing wall 41 and pulls the hair dryer to the right. Furthermore the catch 45 is in this case located at different point of the hair dryer. Integrally combined with the pivot pin 42 in the direction of rotation is again an index plate 46 which activates the reversing switch 3 in dependency upon the two positions shown in FIGS. 9 and 10.

While the invention has been described by reference to specific embodiments, this was for purposes of illustration only and should not be construed to limit the spirit or the scope of the invention.

I claim:

1. A hair drying device, comprising a rotatable curling iron, a reversible motor for driving said curling iron in opposite directions, a reversing switch operable between first and second positions for causing said motor to reverse its direction of rotation, a hair dryer including an outflow nozzle for directing hot air produced by said hair dryer tangentially at hair wound upon said curling iron, said outflow nozzle being movable between first and second positions, said outflow nozzle and said reversing switch being coupled together so that s id curling iron is caused to rotate in a first direction when said outflow nozzle is in its first position, and so that said curling iron is caused to rotate in a second direction when said outflow nozzle is in its second position, and an electric circuit disposed between a source of electricity and said reversible motor, said electric circuit including a first switch actuated directly by said reversing switch and a second switch actuated by said reversing switch after a predetermined time delay.

2. The hair drying device of claim 1, wherein said electric circuit includes a first circuit means including said first switch and a second circuit means including said second switch for connecting said motor to said source of electricity, first and second relays associated with said first and second switches respectively, and an RC circuit associated with said second relay, said motor being driven in a first direction when said first and second switches are each in their first position, said motor being driven in an opposite direction when said first and second switches are each in their second position, said first switch being caused to change position when said reversing switch changes positions, said second switch being caused to change positions after a predetermined time delay determined by said RC circuit after said reversing switch changes positions.

3. The hair drying device of claim 2 further comprising a starting switch for said drive motor in said circuit means.

4. The hair drying device of claim 1 further comprising a housing supporting said hair dryer and said curling iron, and an index plate disposed on said outflow nozzle for changing the position of said reversing switch, said index plate travelling between first and second positions with said outflow nozzle in an arcuate groove of a wall of said housing.

5. The hair drying device of claim 4 further comprising biasing means for causing said outflow nozzle to press against a housing wall.

6. The hair drying device of claim 5 further including catching means for setting said outflow nozzle into position against said housing wall, said catching means providing limited adjustable movement against the force of said biasing means.

7. The hair drying device of claim 1 wherein said outflow nozzle is disposed perpendicularly to said hair dryer, said outflow nozzle including holding means of U-shaped cross-section extending around a housing wall so that said housing wall is surrounded by two legs of said U-shape.

8. The hair drying device of claim 1, wherein said outflow nozzle includes a wall extending parallel to a direction of outflow, said outflow nozzle wall including holding means of U-shape cross-section extending around a housing wall, said reversing switch being located on said housing wall away from said outflow nozzle and being actuated by an index plate which is connected to said holding means.

9. The hair drying device of claim 1, wherein said outflow nozzle is formed integrally with said hair dryer, said outflow nozzle including a guiding collar which receives a housing wall, and an index plate o said housing wall for changing the position of said reversing switch.

10. The hair drying device of claim 1 wherein said hair dryer is mounted coaxially with a direction of outflow.

11. The hair drying device of claim 10 further comprising pivoting means disposed through a housing wall, said hair dryer being pulled against said housing wall by a biasing means, and setting means between said hair dryer and said housing wall for holding said hair dryer in position.

* * * * *